United States Patent [19]

Persson

[11] Patent Number: 4,727,686

[45] Date of Patent: Mar. 1, 1988

[54] APPARATUS FOR FINISHING FLAT SURFACES

[75] Inventor: Gert Persson, Lyckeby, Sweden

[73] Assignee: Dynapac AB, Solna, Sweden

[21] Appl. No.: 905,199

[22] Filed: Sep. 9, 1986

[30] Foreign Application Priority Data

Sep. 9, 1985 [SE] Sweden ..... 8504164

[51] Int. Cl.[4] ..... B24B 23/00; A47L 11/00; E21C 47/00

[52] U.S. Cl. ..... 51/174; 51/177; 299/41; 15/49 R

[58] Field of Search ..... 51/177, 174, 170 T, 51/267; 299/41; 15/49–52; 254/89 H, 2 R, 2 C, 3 R, 3 C

[56] References Cited

U.S. PATENT DOCUMENTS 2,201,420 5/1940 Zschau ..... 51/177
3,146,559 9/1964 Wilkinson ..... 51/177

FOREIGN PATENT DOCUMENTS 1482089 3/1966 France .

*Primary Examiner*—Frederick R. Schmidt
*Assistant Examiner*—Maurina Rachuba
*Attorney, Agent, or Firm*—Walter Ottesen

[57] ABSTRACT

A self-propelled grinding or milling apparatus for finishing a surface of concrete or similar hard material such as a floor, which includes a frame supported on a number of wheels. A rotating grinding or milling tool is mounted in the frame and has a vertical shaft which is suspended and loaded with weights so that the pressure of the wheels on the surface is maintained at a constant level at varying working pressures of the tool. The apparatus is arranged to tilt laterally by means of a raising and lowering device which acts on the non-steerable wheels so that the pressure of the tool on the floor differs on the right-hand and left-hand side of the apparatus and so gives rise to frictional forces which cause the apparatus to move either in the forward direction or the rearward direction at a speed which is dependent on the magnitude of the tilt.

5 Claims, 6 Drawing Figures

APPARATUS FOR FINISHING FLAT SURFACES

FIELD OF THE INVENTION

The invention relates to an apparatus for finishing flat surfaces such as floors of stone, concrete or similar hard materials. The apparatus includes a frame equipped with a number of wheels and on which a power unit is mounted for driving a finishing tool. The finishing tool is mounted on a vertical shaft so as to be capable of rotation.

BACKGROUND OF THE INVENTION

Apparatus of the kind referred to above is disclosed in U.S. Pat. No. 4,317,314 and does not include means for laterally inclining the tool. Also, the apparatus is dependent on external forces for its propulsion usually by the operator pushing or pulling the apparatus in the desired direction, which especially in the case of large cutting depths requires considerable effort and so constitutes a major ergonomic inconvenience.

In similar apparatus in other areas, for example, sweeping machines of the type disclosed in U.S. Pat. No. 2,978,719, it is known that by angling the two brush shafts in a vertical plane at right angles to the direction of motion of the apparatus, and consequently also the brushes in relation to the floor, a certain driving force in a forward or rearward direction can be obtained.

The disadvantage of this latter solution is that the angling device is comparatively complicated and sensitive to damage and is scarcely suitable for heavier machines like grinders or millers where high contact pressure on the floor is required. Above all, the angling device becomes complicated when applied to grinding machines of the kind described in the above-mentioned Swedish patent with facilities for varying the contact pressure of the grinding or milling tool against the floor.

SUMMARY OF THE INVENTION

It is an object of the invention to provide a concrete surface grinding apparatus which can be self-propelled in a simple manner without the disadvantages associated with apparatus such as the sweeping apparatus described above.

According to a feature of the invention, the finishing tool can be tilted transversely with respect to the longitudinal axis of the apparatus so that it is at an angle with respect to the floor. As a result, when the apparatus is parallel with the floor, the frictional force between tool and floor during rotation of the tool gives rise to forces relative to the longitudinal axis of the apparatus which are of equal magnitude in both forward and rearward directions; and, when the apparatus is angled with respect to the floor, a force resultant occurs in either the forward or rearward directions, depending upon whether the tool is inclined to the right or to the left. Consequently, with the aforementioned lateral inclination of the tool, the apparatus is caused to propel itself either forwards or rearwards at a speed which can be varied according to the magnitude of the lateral inclination.

BRIEF DESCRIPTION OF THE DRAWING

The invention will now be described with reference to the drawing wherein.

DESCRIPTION OF THE PREFERRED EMBODIMENTS OF THE INVENTION

Figure 4:
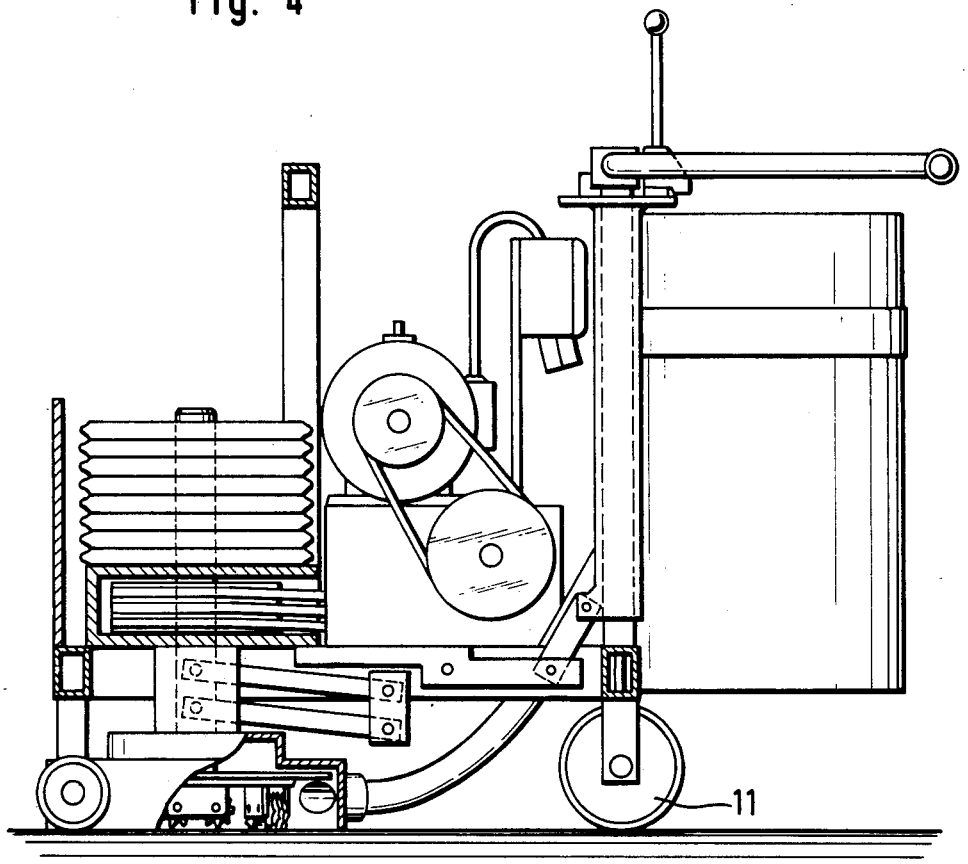

The frame of the grinding apparatus is identified by reference numeral 1. The apparatus is fitted with two non-steerable wheels 6*a*, 6*b* positioned on respective sides of a rotating grinding or milling disc 2 on a vertical shaft 3 to which a grinding or milling tool 5 is resiliently mounted. In addition, the frame is fitted with a steerable wheel 11 (FIG. 4). The shaft 3 is journalled in a bearing housing which, by means of a system of links in the form of tierods, is mounted in the frame in a manner permitting it to be raised and lowered. An apparatus of this kind is shown in U.S. Pat. No. 4,634,188 which is incorporated herein by reference and includes a rearward steerable wheel.

The bearing housing can be loaded with a number of weights 4 corresponding to the grinding pressure it is desired to achieve without causing a change in the normal forces acting on the wheels and the steerable wheel, respectively.

Figure 1A:
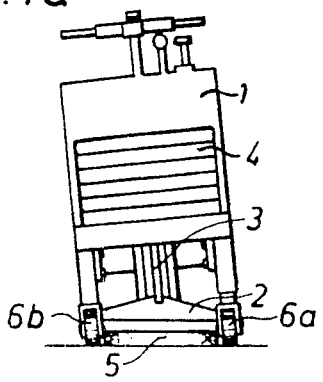
FIG. 1*a* is a front elevation view of a grinding apparatus according to the invention moving in a forward direction.
Figure 2A:
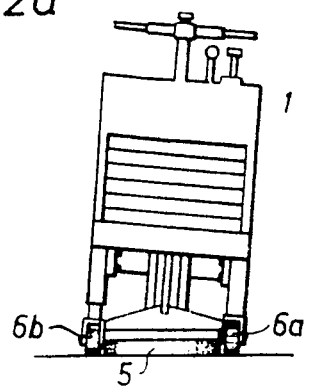
FIG. 2*a* is a front elevation view of a grinding apparatus according to the invention moving in a rearward direction.
Figure 1B:
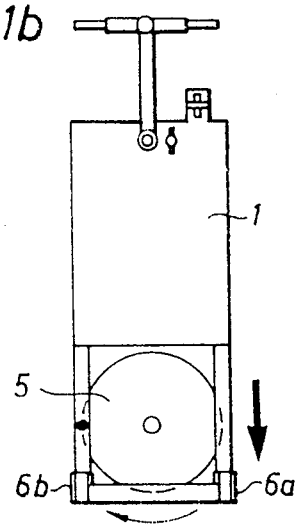
FIG. 1*b* is a plan view of the grinding apparatus of FIG. 1*a;*
Figure 2B:
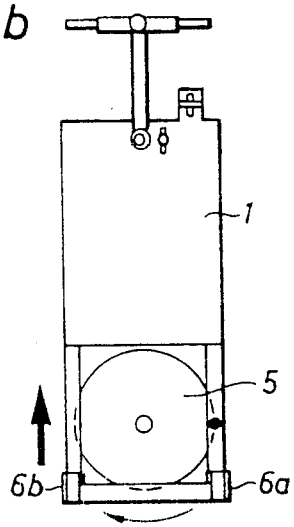
FIG. 2*b* is a plan view of the grinding apparatus of FIG. 2*a;*
Figure 3:
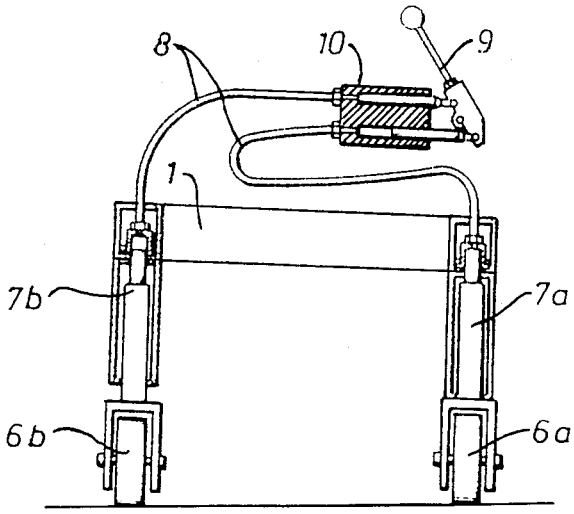
FIG. 3 is a schematic showing how tilting of the grinding apparatus is accomplished by adjusting the height of its wheels; and, FIG. 4 is a side elevation view of a machine for working and smoothing an even surface of the kind which can be equipped with means for tilting the frame thereof laterally to achieve motion in a straight-line direction.

According to a feature of the invention, wheels 6*a* and 6*b* are affixed to the respective hydraulic cylinders 7*a* and 7*b* shown in FIG. 3. The other ends of the cylinders are secured to frame 1. The hydraulic cylinders 7*a* and 7*b* communicate via hydraulic oil lines 8 with a double-acting hydraulic cylinder 10 actuated by a lever 9.

By operating lever 9, the wheels 6*a* and 6*b* are raised and lowered so that the desired tilting of frame 1 is achieved, causing the normal pressure of the grinding or milling tool 5 against the floor to differ on the right and left side as viewed in the direction of the longitudinal axis of the apparatus; this causes a resultant force to develop which moves the apparatus in forward or rearward direction depending upon whether it is tilted to the right or to the left.

The same effect can of course also be achieved by arranging weights 4, which load the bearing housing, in an adjustable asymmetric manner in relation to the right-hand and left-hand side of the longitudinal axis of symmetry of the apparatus.

It is understood that the foregoing description is that of the preferred embodiments of the invention and that various changes and modifications may be made thereto without departing from the spirit and scope of the invention as defined in the appended claims.

What is claimed is:

1. A grinding and milling apparatus for smooth-finishing a flat surface such as a floor of concrete or similar hard material, the apparatus comprising:

an elongated frame having a forward end and a rearward end and defining a plane parallel to said surface;

first wheel means non-pivotable about an axis perpendicular to said plane and mounted on the left-hand side of said forward end of said frame for supporting said frame on said surface;

second wheel means non-pivotable about an axis perpendicular to said plane and mounted on the right-hand side of said forward end of said frame for supporting said frame on said surface;

said frame further defining a longitudinal axis midway between said first wheel means and second wheel means;

said first wheel means and said second wheel means being mounted on said frame so as to facilitate forward or rearward movement in the direction of said longitudinal axis;

rotatable abrasive means mounted on said forward end of said frame between said first wheel means and said second wheel means for imparting a rotative abrasive action to said flat surface on both sides of said axis;

weight means mounted on said abrasive means for imparting a predetermined grinding pressure to said abrasive means;

third wheel means mounted on said rearward end of said frame remote from said rotatable abrasive means and from said first and second wheel means for coacting with said first and second wheel means to support said frame above the flat surface independently of said abrasive means;

adjusting means operatively connected to said first and second wheel means for lifting or lowering said frame with respect to either one of said wheel means to laterally tilt said frame and said weight means to the left or right when viewed in the direction of said axis thereby causing said abrasive means to develop a greater friction force on one side of said axis than on the other side of said axis and so impart a resultant force to said frame in a straight-line direction along said axis to self-propel said apparatus forwardly or rearwardly in the straight-line direction of said axis and in dependence upon the direction of the lateral tilt with respect to said axis; and, said adjusting means including first actuating means connected directly to said first wheel means and interposed between said first wheel means and said frame for lifting said frame with respect to said first wheel means so as to tilt said frame laterally to the right-hand side about said longitudinal axis; second actuating means connected directly to said second wheel means and interposed between said second wheel means and said frame so as to tilt said frame laterally to the left-hand side about said longitudinally axis; and, means connected to said first and second actuating means for actuating a selected one of said actuating means so as to cause said apparatus to be self-propelled in a straight-line direction along said longitudinal axis.

2. The apparatus of claim 1, said first actuating means being a first hydraulic cylinder having a cylinder end and a piston end, one of said ends being connected to said first wheel means and the other one of said being connected to said frame; said second actuating means being a second hydraulic cylinder having a cylinder end and a piston end, one of said ends of said second hydraulic cylinder being connected to said second wheel means and the other one of said ends of said second hydraulic cylinder being connected to said frame; and said means connected to said first and second actuating means being a double-acting cylinder for selectively acutating said hydraulic cylinders; and, said adjusting means further comprising hydraulic lines interconnecting said double-acting cylinder and said cylinders.

3. The apparatus of claim 1, said adjusting means comprising a first hydraulic cylinder connected to said first wheel means and interposed between said first wheel means and said frame for lifting said frame with respect to said first wheel means so as to tilt said frame laterally to the right-hand side; a second hydraulic cylinder connected to said second wheel means and interposed between said second wheel means and said frame so as to tilt said frame laterally to the left-hand side; and, lever-actuated double-acting cylinder means connected to said first and second hydraulic cylinders for actuating a selected one thereof so as to cause said apparatus to be self-propelled in a direction along said longitudinal axis.

4. The apparatus of claim 3, wherein the lever of said double-acting cylinder is pivotally mounted for movement between first and second positions for actuating said first and second hydraulic cylinders, respectively.

5. The apparatus of claim 4, said double-acting cylinder comprising resilient biasing means for holding the lever in a neutral position when the latter is not actuated; and, hydraulic lines interconnecting said double-acting cylinder and said hydraulic cylinder.

* * * * *

UNITED STATES PATENT AND TRADEMARK OFFICE

CERTIFICATE OF CORRECTION

PATENT NO. : 4,727,686

DATED : March 1, 1988

INVENTOR(S) : Gert Persson

It is certified that error appears in the above-identified patent and that said Letters Patent is hereby corrected as shown below:

In column 1, line 38: delete "Swedish" and substitute -- U.S. Pat. No. 4,317,314 -- therefor.

In column 4, line 24: delete "acutating" and substitute -- actuating -- therefor.

In column 4, line 26: after the word "said" (second occurrence), insert -- hydraulic --.

Signed and Sealed this

Thirteenth Day of September, 1988

*Attest:*

*Attesting Officer*

DONALD J. QUIGG

*Commissioner of Patents and Trademarks*